US010669125B2

(12) United States Patent
Miyajima et al.

(10) Patent No.: US 10,669,125 B2
(45) Date of Patent: Jun. 2, 2020

(54) ELEVATOR ROPE GUIDE SYSTEM

(71) Applicant: Otis Elevator Company, Farmington, CT (US)

(72) Inventors: Hiromitsu Miyajima, Inzai (JP); Daisuke Meguro, Tokyo (JP); Naoki Taniguchi, Sakura (JP); Atsunori Kondo, Sakura (JP); Takako Fukuyama, Narita (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 324 days.

(21) Appl. No.: 15/594,869

(22) Filed: May 15, 2017

(65) Prior Publication Data

US 2018/0327226 A1 Nov. 15, 2018

(51) Int. Cl.
*B66B 7/06* (2006.01)
*B66B 7/02* (2006.01)

(52) U.S. Cl.
CPC ..... *B66B 7/06* (2013.01); *B66B 7/021* (2013.01); *B66B 7/023* (2013.01)

(58) Field of Classification Search
CPC ..... B66B 7/06; B66B 7/021; B66B 7/023
See application file for complete search history.

(56) References Cited

U.S. PATENT DOCUMENTS 3,662,862 A * 5/1972 Pollen ..... B66B 7/06 187/407
3,666,051 A * 5/1972 Davis ..... B66B 7/06 187/414
4,117,908 A * 10/1978 Nara ..... B66B 7/06 187/254
5,025,893 A * 6/1991 Saito ..... B66B 7/06 187/266
5,103,937 A * 4/1992 Robertson ..... B66B 7/06 174/42

(Continued)

FOREIGN PATENT DOCUMENTS

CN 1105336 A 7/1995
CN 1318505 A 10/2001

(Continued)

OTHER PUBLICATIONS

Miura, et al., "Vibration Reduction of a Building—Elevator System Considering the Intensity of Earthquake Excitation", 15 WCEE, Lisboa 2012, 10 pages.

(Continued)

*Primary Examiner* — Michael A Riegelman
(74) *Attorney, Agent, or Firm* — Cantor Colburn LLP

(57) ABSTRACT

An elevator rope guide system comprises a plurality of rope guides for restricting the swaying of at least one main rope and a plurality of stop mechanisms each configured to stop a corresponding rope guide. The rope guides are located above an elevator car and/or counterweight and are vertically movable along a hoistway. The stop mechanisms are positioned at different intermediate heights along the hoistway. The elevator rope guides are collected by the elevator car or counterweight as the elevator car or counterweight moves up and are stopped by a corresponding stop mechanism as the elevator car or counterweight moves down.

15 Claims, 8 Drawing Sheets

(56) References Cited

U.S. PATENT DOCUMENTS

| | | | | |
|---|---|---|---|---|
| 5,509,503 | A * | 4/1996 | Salmon | B66B 11/08 187/266 |
| 6,364,062 | B1 * | 4/2002 | Ericson | B66B 7/062 187/264 |
| 6,415,893 | B1 * | 7/2002 | de Jong | B66B 7/06 187/413 |
| 6,488,125 | B1 * | 12/2002 | Otsuka | B66B 7/068 187/254 |
| 7,448,474 | B2 * | 11/2008 | Aulanko | B66B 19/00 187/250 |
| 7,793,763 | B2 | 9/2010 | Zhu et al. | |
| 9,038,782 | B2 * | 5/2015 | Blanchard | B66B 7/08 187/411 |
| 9,067,761 | B2 * | 6/2015 | Ropponen | B66B 7/06 |
| 9,359,172 | B2 * | 6/2016 | Mangini | B66B 5/021 |
| 9,446,931 | B2 * | 9/2016 | Mustalahti | B66B 11/08 |
| 10,336,578 | B2 * | 7/2019 | Legua | |
| 2003/0102613 | A1 * | 6/2003 | Alves | B66B 7/046 267/140 |
| 2010/0065381 | A1 * | 3/2010 | Roberts | B66B 7/06 187/401 |
| 2010/0236872 | A1 * | 9/2010 | Miller | B66B 11/0273 187/401 |
| 2016/0236905 | A1 * | 8/2016 | Zerelles | B66B 7/06 |
| 2017/0113901 | A1 * | 4/2017 | Legua | B66B 9/187 |
| 2017/0369281 | A1 * | 12/2017 | Miseur | B66B 7/06 |
| 2018/0327226 | A1 * | 11/2018 | Miyajima | B66B 7/06 |

FOREIGN PATENT DOCUMENTS

| | | | |
|---|---|---|---|
| EP | 1558514 | B1 | 3/2012 |
| EP | 2923988 | A1 | 9/2015 |
| JP | H11209031 | A | 8/1999 |
| JP | 2007284222 | A | 11/2007 |
| JP | 2012218863 | A | 11/2012 |

OTHER PUBLICATIONS

European Search Report for application EP 18172173, dated Oct. 24, 2018, 9 pages.

Chinese First Office Action for application CN 201810460407.0, dated Jul. 3, 2019, 9 pages.

* cited by examiner

ELEVATOR ROPE GUIDE SYSTEM

BACKGROUND

This invention generally relates to elevator systems. More particularly, this invention relates to an elevator rope guide system for restricting the swaying of main ropes in a high rise building.

Elevator systems are useful for carrying passengers between various levels in a building, for example. There are various known types of elevator systems. Different design considerations dictate what type of components are included in an elevator system. For example, elevator systems in high rise buildings have different requirements than those for buildings that include only a few floors.

One issue that is present in many high rise buildings is a tendency to experience rope sway under various conditions. Rope sway may occur, for example, during earthquakes or very high wind conditions because the building will move responsive to the earthquake or high winds. As the building moves, long ropes associated with the elevator car and counterweight will tend to sway from side to side. Excessive rope sway conditions are undesirable for two main reasons; they can cause damage to the ropes or other equipment in the hoistway and their motion can produce objectionable vibration levels in the elevator car.

One elevator rope guide system is shown in U.S. Pat. No. 3,666,051 issued on May 30, 1972. This patent discloses a cable stabilizer for an open shaft elevator which comprises a guide member through which the cables of the elevator pass and a pair of stops carried on the guide rails so as to prevent the guide member from dropping below an intermediate location. This cable stabilizer may work for an outdoor elevator or an elevator in a low rise building but is not adequate for a high rise building with longer ropes.

In view of the above and other considerations, there is a need for an elevator rope guide system for use with an elevator system in a high rise building.

BRIEF SUMMARY

According to one embodiment of the invention, an elevator rope guide system comprises a plurality of rope guides for restricting the swaying of at least one main rope and a plurality of stop mechanisms each configured to stop a corresponding rope guide. The rope guides are located above an elevator car and/or counterweight and are vertically movable along a hoistway. The stop mechanisms are positioned at different intermediate heights along the hoistway. The elevator rope guides are collected by the elevator car or counterweight as the elevator car or counterweight moves up and are stopped by a corresponding stop mechanism as the elevator car or counterweight moves down.

According to another embodiment of the invention, an elevator system comprises an elevator car and counterweight positioned within a hoistway, guide rails for respectively guiding the elevator car and counterweight, at least one main rope for hoisting the elevator car and counterweight and a rope guide system. The guide rails are respectively provided on a wall of the hoistway on both sides of the elevator car and counterweight. The rope guide system includes a plurality of rope guides for restricting the swaying of the at least one main rope and a plurality of stop mechanisms each configured to stop a corresponding rope guide. The rope guides are located above the elevator car and/or counterweight and are vertically movable along the hoistway. The stop mechanisms are positioned at different intermediate heights along the hoistway. The elevator rope guides are collected by the elevator car or counterweight as the elevator car or counterweight moves up and are stopped by a corresponding stop mechanism as the elevator car or counterweight moves down.

The detailed description explains embodiments of the invention, together with advantages and features, by way of example with reference to the drawings.

DETAILED DESCRIPTION

Figure 1:
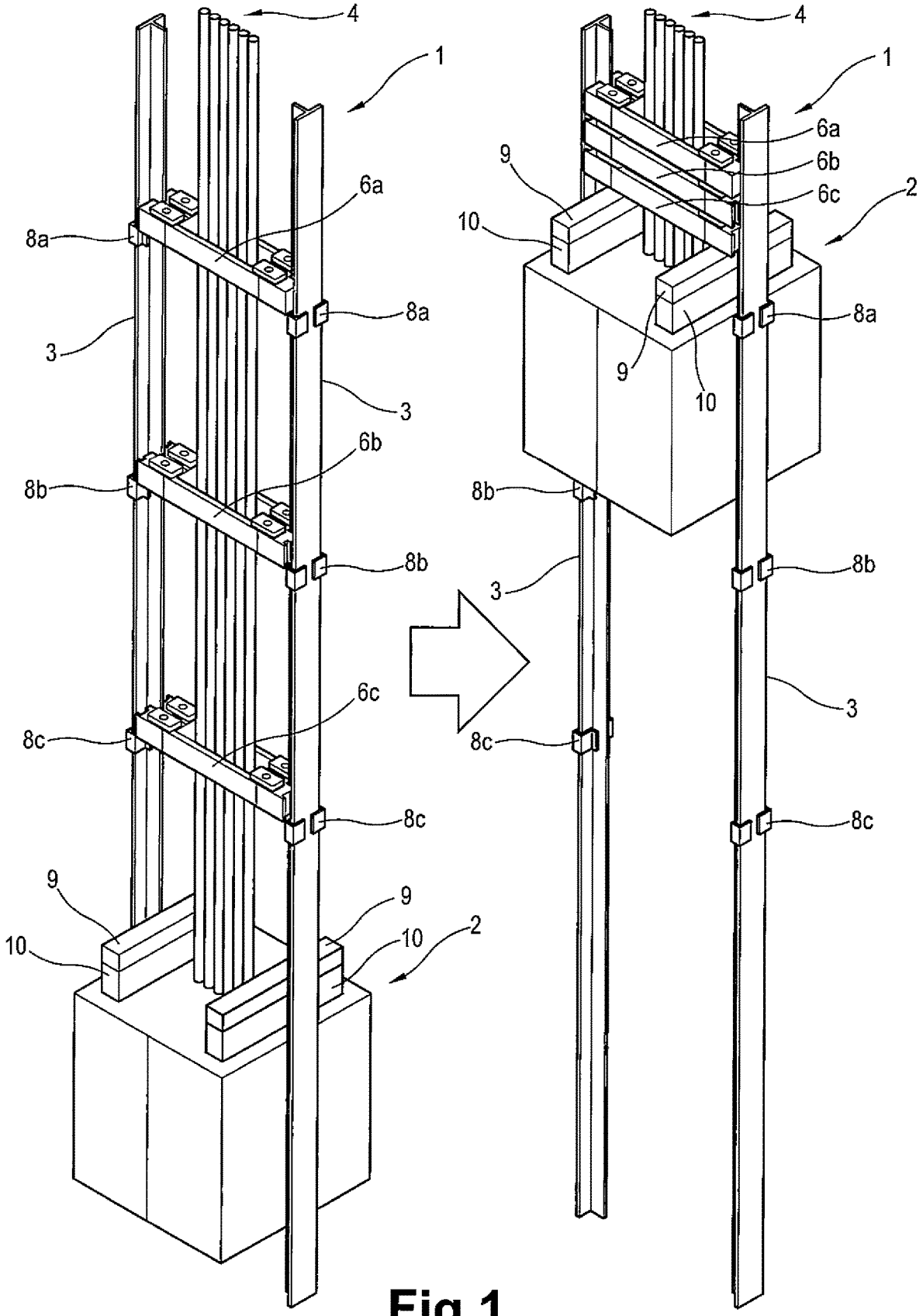
FIG. 1 is a schematic view of an elevator system including the elevator rope guide system of the present invention.

FIG. 1 schematically shows selected portions of an elevator system 1 of the present invention. An elevator car 2 is guided along T-shaped guide rails 3 respectively positioned on a hoistway wall (not shown) at opposite sides of the elevator car 2 as is conventional. A plurality of main ropes 4 couple the elevator car 2 to a counterweight (not shown). The main ropes 4 support the weight of the elevator car 2 and counterweight and propel them in a desired direction within a hoistway. In this embodiment, the main ropes 4 comprise round steel ropes but the main ropes 4 may comprise belts including a plurality of longitudinally extending wire cords and a coating covering the wire cords. A variety of roping configurations may be useful in an elevator system that includes features designed according to an embodiment of this invention.

On the left side of FIG. 1, the elevator car is shown in a lowermost position. A plurality of rope guides 6 are positioned above the elevator car 2 at different intermediate heights along the hoistway. In this embodiment, there are three rope guides 6, an upper rope guide 6*a*, an intermediate rope guide 6*b* and a lower rope guide 6*c*. The rope guides 6 are configured to slidably engage the guide rails 3 at opposite ends thereof. A plurality of pairs of stops 8 are carried on the guide rails 3 at different intermediate heights along the hoistway such as to support a corresponding rope guide 6 at a respective height. In this embodiment, there are three pairs of stops 8, a pair of upper stops 8*a*, a pair of intermediate stops 8*b* and a pair of lower stops 8*c*.

On the right side of FIG. 1, the elevator car 2 is shown in an uppermost position. As the elevator car 2 moves up, the plurality of rope guides 6 are collected on top of the elevator car 2 and move up along the guide rails 3 together with the elevator car 2. As the elevator car 2 moves down and returns to the position shown on the left hand side of FIG. 1, the rope guides 6 are each prevented by a corresponding stop 8 from dropping below a respective location. As will be understood, the stops 8 are positioned such that they do not interfere with the guides of the elevator car 2.

On top of the elevator car 2, buffers 9 are provided for absorbing impact with the rope guides 6. The buffers 9 may comprise a rubber material positioned on an adjusting unit 10. The adjusting unit 10 may adjust the height of the buffer 9 such that the buffer 9 contacts and holds the rope guides 6 at a position that does not interfere with the components positioned on top of the elevator car 2.

Figure 2:
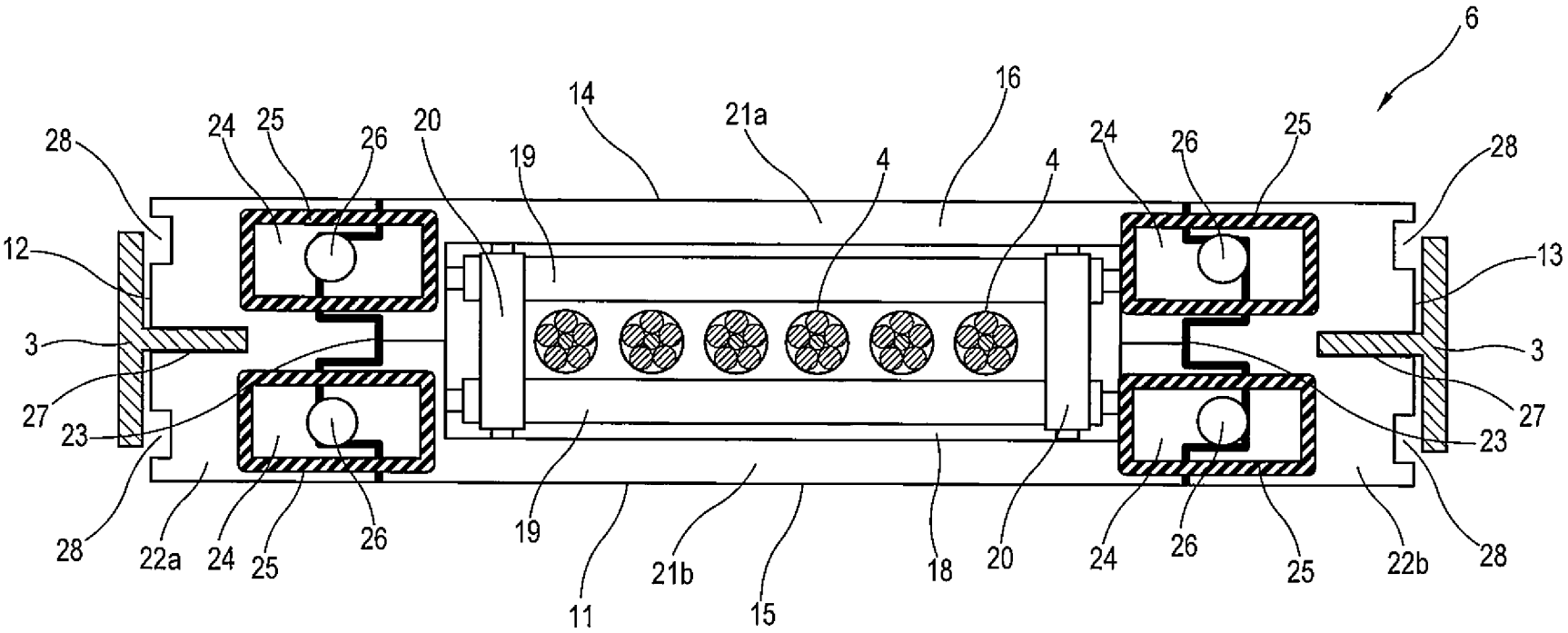
FIG. 2 is a partially sectional elevation view of a rope guide of the elevator rope guide system of FIG. 1.
Figure 3:
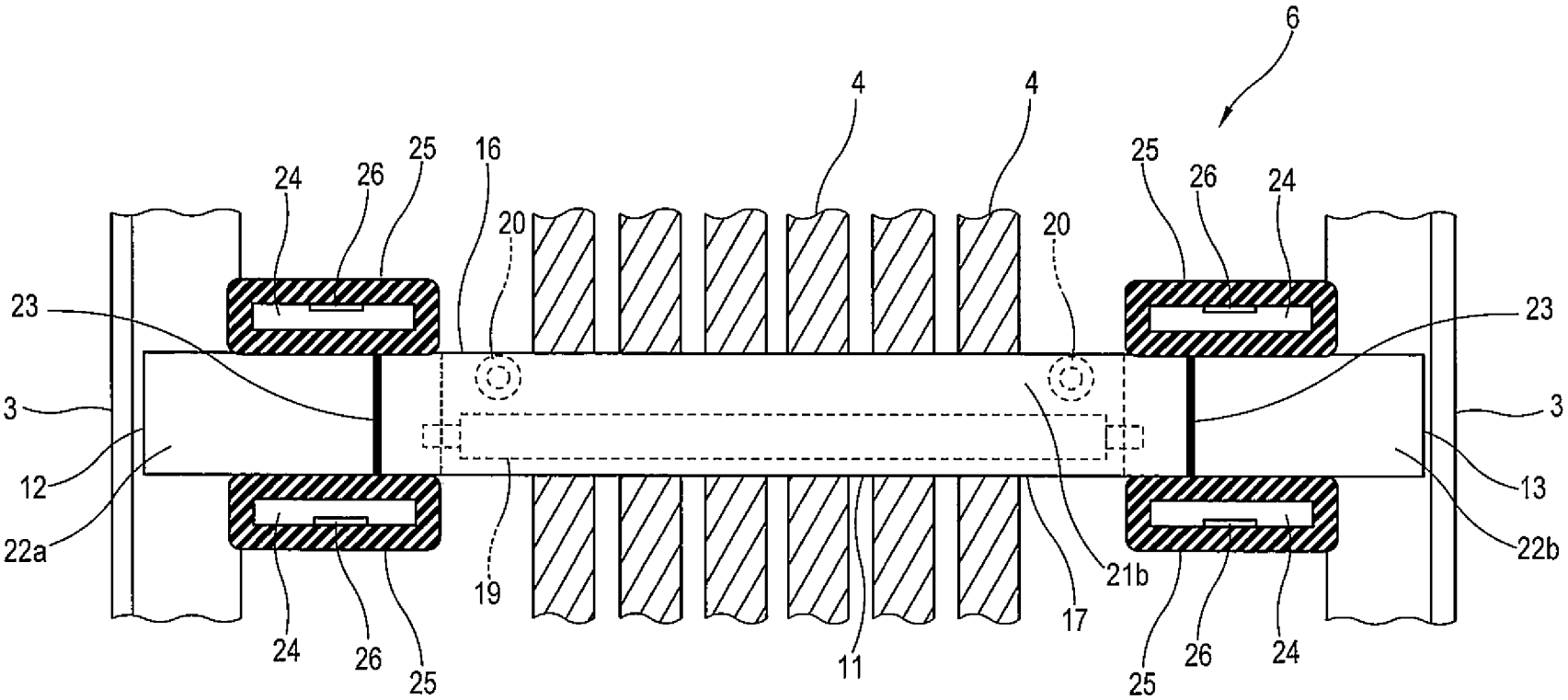
FIG. 3 is a side view of the rope guide of FIG. 2.

FIGS. 2 and 3 illustrate one example rope guide 6. The rope guide 6 comprises a rectangular frame 11 with a first end 12 and a second end 13 facing the guide rails 3, a first side 14 and a second side 15 perpendicular to the first and second ends 12, 13 and an upper surface 16 and a lower surface 17. The frame 11 comprises a window 18 for allowing the main ropes 4 to extend there through. The window 18 includes a pair of longitudinal rollers 19 and a pair of lateral rollers 20 perpendicular to the longitudinal rollers 19. The rollers 19, 20 surround the main ropes 4 with the spacing between the rollers 19, 20 minimizing contact between the rollers 19, 20 and the main rope 4 except for under conditions where an undesired amount of lateral movement of the main ropes 4 is occurring. Under sway conditions, the rollers 19, 20 roll about axes responsive to contact with the main ropes 4 to restrict the swaying of the main ropes 4.

The frame 11 includes a frame body 21 which may be divided into two parts 21*a*, 21*b* and side segments 22*a*, 22*b* at both ends of the frame body 21 to allow easy assembly of the frame 11. A cushion rubber 23 may be provided between the frame body 21 and side segments 22 to reduce transmission of vibration to the guide rail 3 resulting from contact between the main ropes 4 and the rollers 19, 20.

Dampers 24 are provided on the upper and lower surfaces 16, 17 of the frame. In this embodiment, four dampers 24 are provided on each surface 16, 17 of the frame 11 and two dampers 24 are respectively placed on both sides of the window 18. The dampers 24 each include a hollow rubber body 25 and a permanent magnet 26 placed on or near the upper surface of the hollow rubber body 25. When the rope guides 6 are collected by the elevator car 2, the elevator car 2 runs into the rope guides 6 resting on the stops 8. The hollow rubber body 25 absorbs impact between the rope guides 6 and the buffer 9 of the elevator car 2 and between the rope guides 6. The permanent magnets 26 are positioned to oppose the permanent magnets 26 on proximal rope guides 6. The opposed permanent magnets 26 are arranged with like poles facing one another to magnetically interact with one another and lessen the impact of the shock. The buffer 9 of the elevator car 2 may also comprise a hollow rubber body and permanent magnet similar to the rope guides 6.

The first and second ends 12, 13 of the frame 11 each have a recess 27 for engaging an opposed guide rail 3. The recesses 27 may be coated with Teflon© so that the rope guide 6 is able to slide along the guide rails 3. The intermediate rope guide 6*b* and the lower rope guide 6*c* include notches 28 on both sides of the recesses 27 on both ends 12, 13 of the frame 11.

Figure 4A:
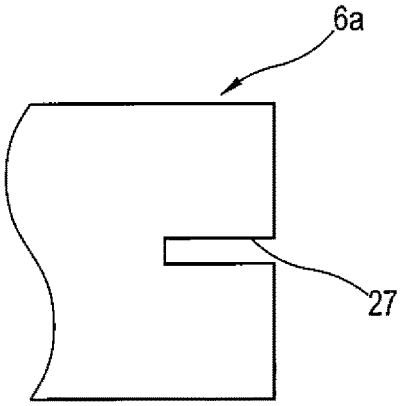
FIGS. 4A to 4C are partial diagrammatic views of the rope guides of the elevator rope guide system of FIG. 1.
Figure 4B:
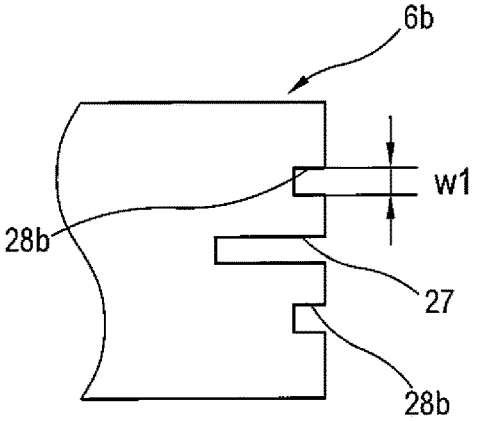
Figure 4C:
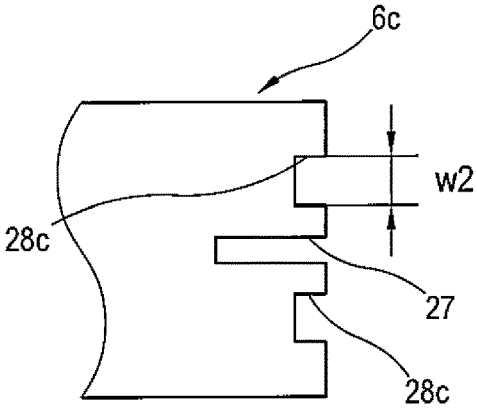
Figure 5A:
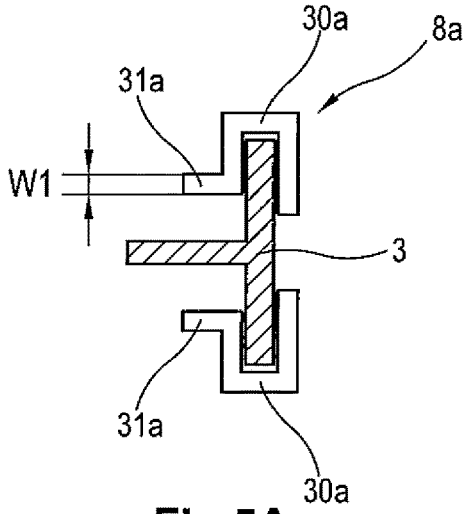
FIGS. 5A to 5C are partial diagrammatic views of the stops of the elevator rope guide system of FIG. 1 carried on a guide rail.
Figure 5B:
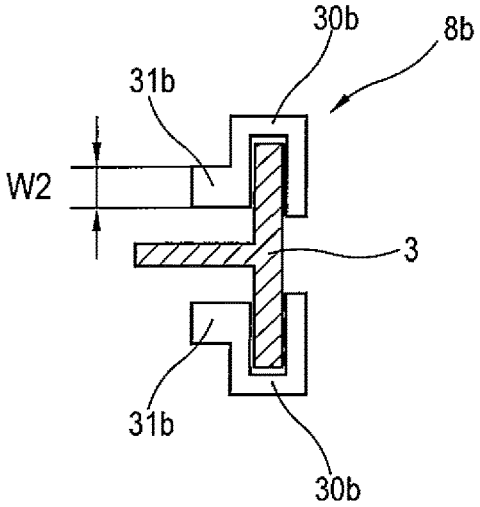
Figure 5C:
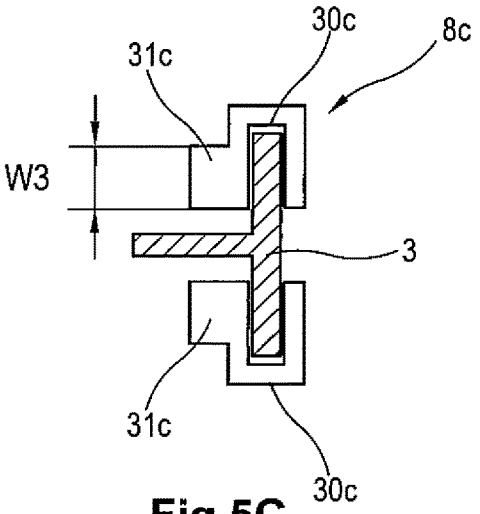
Figure 6A:
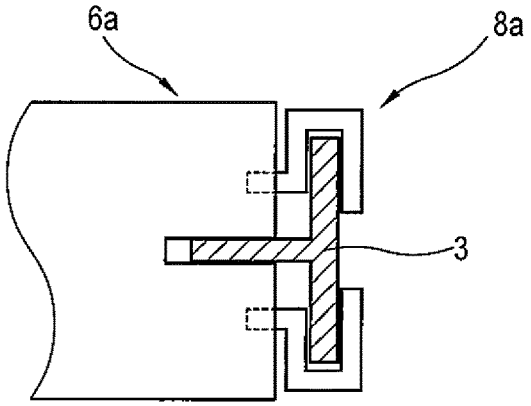
FIGS. 6A to 6C are partial diagrammatic views of the rope guides and stops of FIGS. 4 and 5 overlapping each other.
Figure 6B:
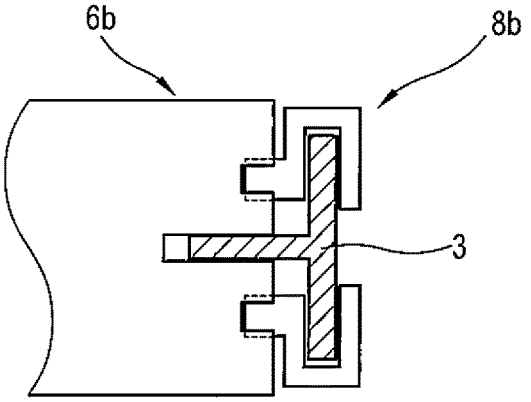
Figure 6C:
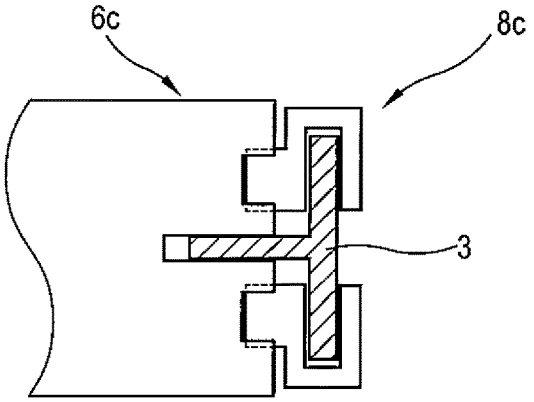

FIGS. 4 to 6 show the dimensional relationships between the rope guides 6 and stops 8. FIG. 4A shows the upper rope guide 6*a*, FIG. 4B shows the intermediate rope guide 6*b* and FIG. 4C shows the lower rope guide 6*c*. The upper rope guide 6*a* does not include any notches. The intermediate rope guide 6*b* includes notches 28*b* with a width w1. The lower rope guide 6*c* includes notches 28*c* with a width w2 larger than w1 (w1<w2).

With reference to FIGS. 5A to 5C, each stop of the pair of stops 8 includes two stop members 30 each attached to opposing flanges of the guide rail 3. The stop members 30 each have a portion 31 protruding inwardly from the guide rail 3. As shown in FIG. 5A, the protruding portions 31*a* of the stop members 30*a* of the upper stop 8*a* have a maximum width of W1. As shown in FIG. 5B, the protruding portions 31*b* of the stop members 30*b* of the intermediate stop 8*b* have a maximum width of W2 larger than W1 and, as shown in FIG. 5C, the protruding portions 31*c* of the stop members 30*c* of the lower stop 8*c* have a maximum width of W3 larger than W2 (W1<W2<W3). FIG. 6 shows the rope guides 6 overlapping the stops 8.

In this embodiment, W1 is smaller than w1 and w2, W2 is larger than w1 and smaller than w2, and W3 is larger than w2. By these dimensional relationships, as the elevator car 2 moves down from the uppermost position shown on the right side of FIG. 1 past the upper stops 8*a*, the lower rope guide 6*c* and the intermediate rope guide 6*b* are allowed to pass the upper stops 8*a* but the upper rope guide 6*a* contacts the upper stops 8*a* and comes to rest. As the elevator car 2 further moves down past the intermediate stops 8*b*, the lower rope guide 6*c* is allowed to pass the intermediate stops 8*b* but the intermediate rope guide 6*b* engages the intermediate stops 8*b* and comes to rest. As the elevator car 2 further moves down past the lower stops 8*c*, the lower rope guide 6*c* engages the lower stops 8*c* and comes to rest. In this way, the rope guides 6 are stopped by a corresponding pair of stops 8 at respective heights along the hoistway as the elevator moves down.

Figure 7A:
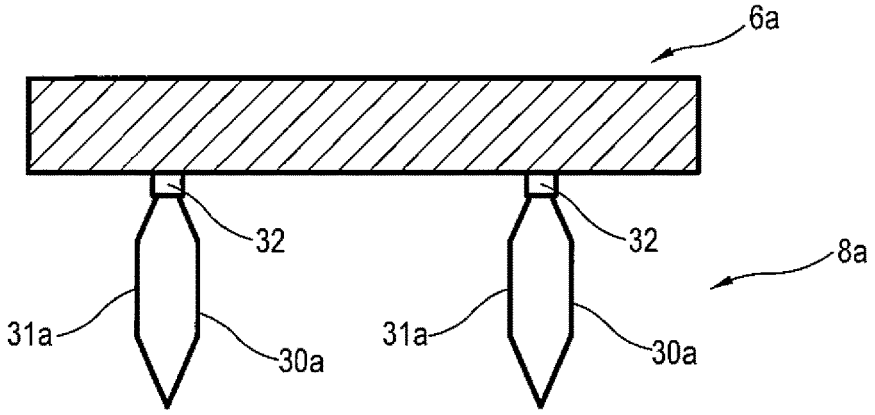
FIG. 7A to 7C is a vertical cross-sectional view of the rope guides and stops of FIGS. 4 and 5 in an engaged position.
Figure 7B:
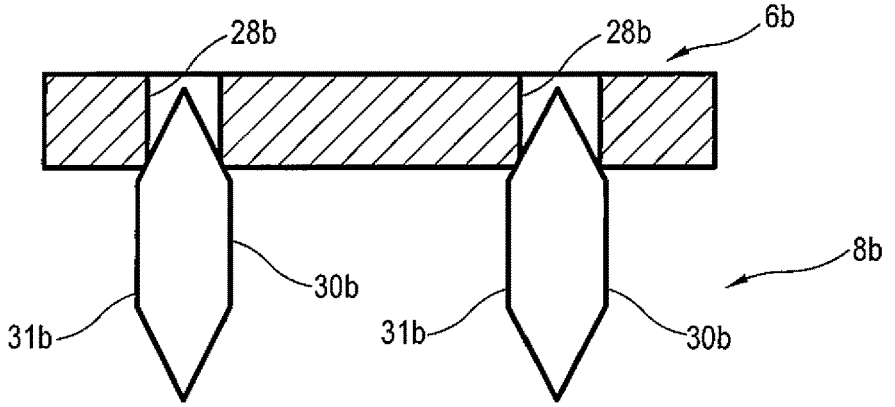
Figure 7C:
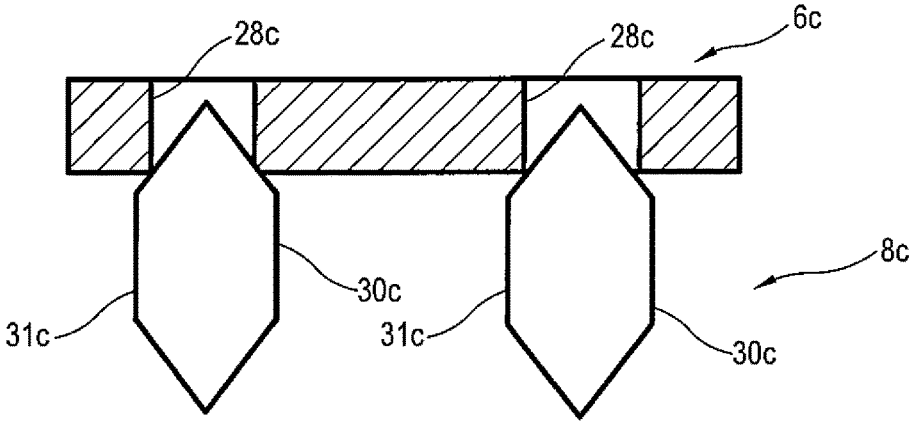

FIGS. 7A to 7C show a vertical cross-sectional view of the rope guides 6 and the protruding portions 31 of the stop members 30 of the stops 8 in an engaged position. The protruding portions 31 have a hexagonal cross-section with a rectangular section elongated in the longitudinal direction parallel to the guide rails 4 and tapered isosceles triangular sections on the top and bottom sides of the rectangular section.

FIG. 7A shows the upper rope guide 6*a* engaged with the stop members 30*a* of the upper stop 8*a*. The stop members 30*a* may include an impact absorption material 32 such as rubber on tips of the protruding portions 31*a* facing the upper rope guide 6*a*. FIG. 7B shows the intermediate rope guide 6*b* engaged with the stop members 30*b* of the intermediate stop 8*b* and FIG. 7C shows the lower rope guide 6*c* engaged with the stop members 30*c* of the lower stop 8*c*. As can be seen from the figures, the protruding portions 31 of the stop members 30 and the notches 28 of the rope guides 6 are vertically aligned. The tapered cross-sectional shape of the protruding portions 31 of the stop members 30 allows the rope guides 6 to smoothly pass the stops 8 and/or allows the stops 8 to precisely stop the rope guides 6 even when the rope guides 6 and stops 8 are slightly misaligned such as by the wobbling of the rope guides 6. The notches 28 may include a shock absorption material such as rubber or a mechanical shock absorber such as a spring to absorb impact with the stops 8.

Figure 8A:
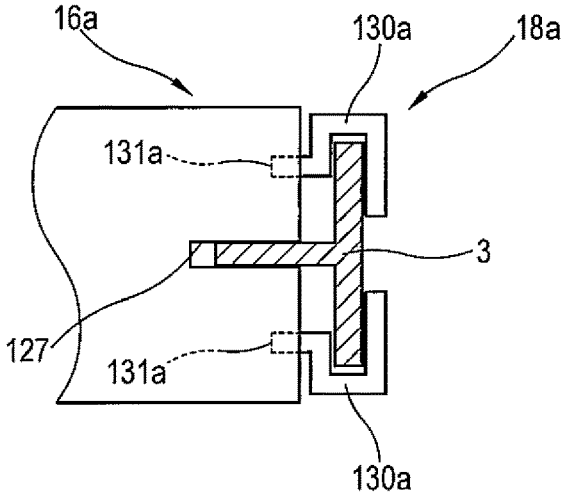
FIGS. 8A to 8C show a further embodiment of the rope guides and stops of the present invention.
Figure 8B:
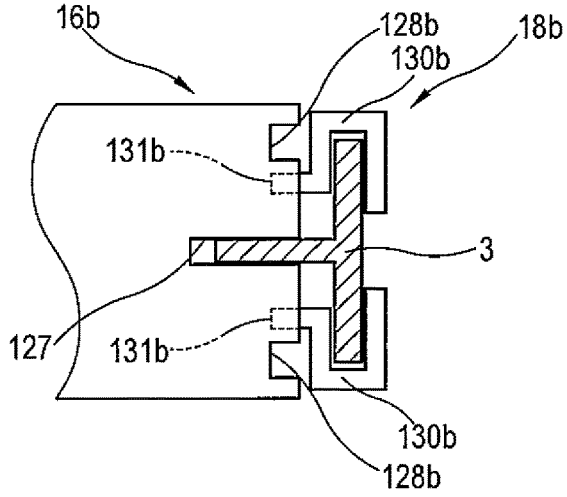
Figure 8C:
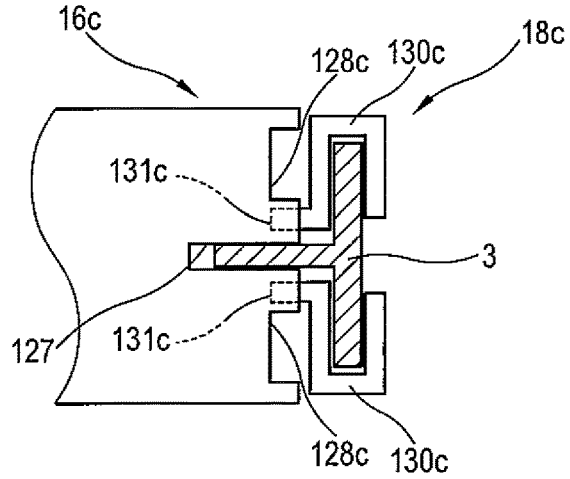

FIGS. 8A to 8C disclose another embodiment of the rope guides and stops of the present invention. FIG. 8A shows an upper rope guide 16*a* and an upper stop 18*a*, FIG. 8B shows an intermediate rope guide 16*b* and an intermediate stop 18*b* and FIG. 8C shows a lower rope guide 16*c* and a lower stop 18*c*.

In this embodiment, the protruding portions 131 of the stops 18 are shifted stepwise in a lateral direction from an outer position shown in FIG. 8A to an inner position closer to the shank portion of the guide rail 3 as shown in FIGS. 8B and 8C. The upper rope guide 16*a* has no notch. The notches 128*b* formed in the intermediate rope guide 16*b* have a width and position such that the intermediate rope guide 16*b* can pass the upper stops 18*a* but can not pass the intermediate stops 18*b*. The notches 128*c* formed in the lower rope guide 16*c* have a width and position such that the lower rope guide 16*c* can pass the upper stops 18*a* and the intermediate stops 18*b* but can not pass the lower stops 18*c*. The width of the notches 128*b* formed in the intermediate rope guide 16*b* is smaller than the width of the notches 128*c* formed in the lower rope guide 16*c*. By the configuration of the stops 18 and notches 128, the rope guides 16 are stopped at respective heights along the hoistway as the elevator car 2 moves down.

In this embodiment, the vertical cross section of the protruding portions 131 of the stop members 130 may have a shape similar to the stop members 30*a* shown in FIG. 7A with shock absorption material on the tips thereof.

Although the elevator rope guide system of the present invention has been explained in relation to an elevator car, it should be understood that it may be equally applied to a counterweight.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An elevator rope guide system, comprising:

a plurality of rope guides for restricting the swaying of at least one main rope, the rope guides located above an elevator car and/or counterweight and vertically movable along a hoistway; and a plurality of stop mechanisms each configured to stop a corresponding rope guide, the stop mechanisms positioned at different intermediate heights along the hoistway;

wherein the elevator rope guides are collected by the elevator car or counterweight as the elevator car or counterweight moves up and are stopped by a corresponding stop mechanism as the elevator car or counterweight moves down;

wherein the rope guides are configured to slide along elevator and/or counterweight guide rails positioned on both sides of the elevator car and/or counterweight and each stop mechanism includes a pair of stops respectively provided on each elevator and/or counterweight guide rail;

wherein at least one rope guide includes at least one notch on both lateral sides facing the elevator and/or counterweight guide rails and the stops of the stop mechanisms respectively include at least one protrusion protruding inward from the elevator and/or counterweight guide rails.

2. The elevator rope guide system of claim 1, wherein each rope guide engages a corresponding stop mechanism and the notches are configured to allow the rope guide to pass the stop mechanisms located above the corresponding stop mechanism.

3. The elevator rope guide system of claim 2, wherein the notches and the protrusions are vertically aligned.

4. The elevator rope guide system of claim 3, wherein there are a plurality of rope guides including the at least one notch on both lateral sides, the notches formed in an upper rope guide having a width w1 smaller than the width w2 of the notches formed in a lower rope guide.

5. The elevator rope guide system of claim 4, wherein the protrusions of an upper stop mechanism has a maximum width W1 smaller than a maximum width W2 of the protrusions of a lower stop mechanism.

6. The elevator rope guide system of claim 2, wherein the protrusions of the stop mechanisms are shifted stepwise to different transverse positions.

7. The elevator rope guide system of claim 6, wherein there are a plurality of rope guides including the at least one notch on both lateral sides, the notches formed in an upper rope guide having a width smaller than the width of the notches formed in a lower rope guide.

8. The elevator rope guide system of claim 1, wherein the rope guides comprise rollers which rotate on contact with the main rope.

9. The elevator rope guide system of claim 1, wherein the rope guides comprise at least one damper including a hollow rubber body.

10. The elevator rope guide system of claim 9, wherein the damper further includes a permanent magnet.

11. The elevator rope guide system of claim 10, wherein the permanent magnet is positioned to oppose a permanent magnet on a proximal rope guide with like poles facing one another.

12. The elevator rope guide system of claim 1, wherein the stops of the stop mechanisms respectively include two stop members, the stop members each including a protrusion protruding inward from the elevator and/or counterweight guide rails.

13. The elevator rope guide system of claim 12, wherein the stop members are attached to the elevator and/or counterweight guide rails.

14. An elevator rope guide system, comprising:

a plurality of rope guides for restricting the swaying of at least one main rope, the rope guides located above an elevator car and/or counterweight and vertically movable along a hoistway; and a plurality of stop mechanisms each configured to stop a corresponding rope guide, the stop mechanisms positioned at different intermediate heights along the hoistway;

wherein the elevator rope guides are collected by the elevator car or counterweight as the elevator car or counterweight moves up and are stopped by a corresponding stop mechanism as the elevator car or counterweight moves down;

wherein the rope guides are configured to slide along elevator and/or counterweight guide rails positioned on both sides of the elevator car and/or counterweight and each stop mechanism includes a pair of stops respectively provided on each elevator and/or counterweight guide rail;

wherein the stops of the stop mechanisms respectively include two stop members, the stop members each including a protrusion protruding inward from the elevator and/or counterweight guide rails;

wherein the protrusions have a vertical cross-section with tapered sections on top and bottom ends.

15. An elevator system, comprising:

an elevator car and counterweight positioned within a hoistway;

guide rails for respectively guiding the elevator car and counterweight, the guide rails respectively provided on a wall of the hoistway on both sides of the elevator car and counterweight;

at least one main rope for hoisting the elevator car and counterweight; and a rope guide system; the rope guide system including:

a plurality of rope guides for restricting the swaying of the at least one main rope, the rope guides located above the elevator car and/or counterweight and vertically movable along the hoistway; and a plurality of stop mechanisms each configured to stop a corresponding rope guide, the stop mechanisms positioned at different intermediate heights along the hoistway;

wherein the elevator rope guides are collected by the elevator car or counterweight as the elevator car or counterweight moves up and are stopped by a corresponding stop mechanism as the elevator car or counterweight moves down;

wherein the rope guides are configured to slide along elevator and/or counterweight guide rails positioned on both sides of the elevator car and/or counterweight and each stop mechanism includes a pair of stops respectively provided on each elevator and/or counterweight guide rail;

wherein at least one rope guide includes at least one notch on both lateral sides facing the elevator and/or counterweight guide rails and the stops of the stop mechanisms respectively include at least one protrusion protruding inward from the elevator and/or counterweight guide rails.

* * * * *